US005238149A

United States Patent [19]

Johnson et al.

[11] Patent Number: 5,238,149

[45] Date of Patent: * Aug. 24, 1993

[54] PINCH TRIGGER HAND PUMP WATER GUN WITH MULTIPLE TANKS

[76] Inventors: Lonnie G. Johnson, 4030 Ridgehurst Dr., Smyrna, Ga. 30080; Bruce M. D'Andrade, 3 Ten Eyck Rd., Whitehouse Station, N.J. 08889

[ * ] Notice: The portion of the term of this patent subsequent to Sep. 29, 2009 has been disclaimed.

[21] Appl. No.: 872,953

[22] Filed: Apr. 22, 1992

Related U.S. Application Data

[63] Continuation-in-part of Ser. No. 841,762, Feb. 28, 1992, Pat. No. 5,150,819, and a continuation-in-part of Ser. No. 680,247, Apr. 3, 1991, abandoned, which is a continuation-in-part of Ser. No. 578,145, Sep. 6, 1990, Pat. No. 5,074,437.

[51] Int. Cl.[5] ..... A63H 3/13

[52] U.S. Cl. ..... 222/79; 222/132; 222/401; 446/473

[58] Field of Search ..... 222/79, 130, 325, 396, 222/399, 400.7, 400.8, 401, 132; 42/54; 446/473; 273/349; 124/70, 73; 239/99

[56] References Cited

U.S. PATENT DOCUMENTS

| | | | |
|---|---|---|---|
| 2,589,977 | 3/1952 | Stelzer | 222/79 |
| 3,197,070 | 7/1965 | Pearl et al. . | |
| 3,578,789 | 5/1971 | Ferri . | |
| 4,214,674 | 7/1980 | Jones et al. . | |
| 4,239,129 | 12/1980 | Esposito . | |
| 4,735,239 | 4/1988 | Salmon et al. . | |
| 4,854,480 | 8/1989 | Shindo . | |
| 5,074,437 | 12/1991 | D'Andrade et al. | 222/79 |
| 5,150,819 | 9/1992 | Johnson et al. | 222/401 X |

*Primary Examiner*—Gregory L. Huson
*Attorney, Agent, or Firm*—Kenneth P. Glynn

[57] ABSTRACT

The present invention is directed to a toy water gun which is operated by selectively releasing water from a pressurized water reservoir. The present invention has a manually operated pump incorporated into the design. As the pump is cycled, water and/or air are drawn from at least one water storage reservoir. Once drawn, the water and/or air are forced into at least one pressure tank. As the amount of water and/or air forced into the pressure tank increases, the pressure of the air displaced by the water within the pressure tank increases. The pressure of the air on the water within the pressure tank increases with each cycle of the pump, until the pump can no longer overcome the pressure of the air on the water within the pressure tank. The pressurized air and water within the pressure tank has an avenue of release that is regulated by the trigger mechanism of the invention which has a safety pressure release within its design. When no force is applied to the trigger, the pressurized water and air are held at bay with no means of release. When force is applied to the trigger, the heavier water is first released from the bottom of the pressurized tank and is channeled through a narrow nozzle. The number of water storage reservoirs and pressure tanks combined totals at least three.

20 Claims, 4 Drawing Sheets

PINCH TRIGGER HAND PUMP WATER GUN WITH MULTIPLE TANKS

REFERENCE TO RELATED CASE

This application is a continuation-in-part of copending U.S. patent application Ser. No. 07/841,762, filed on Feb. 28, 1992, by Bruce M. D'Andrade and Lonnie Johnson, for "Double Tank Pinch Trigger Pump Water Gun", now U.S. Pat. No. 5,150,819, issued on Sep. 29, 1992, which is a File Wrapper Continuation of U.S. patent application Ser. No. 07/680,247, filed on Apr. 3, 1991, having the same inventors and title, and which is now abandoned, and, which is a continuation-in-part of previously copending U.S. patent application Ser. No. 07/578,145, filed on Sep. 6, 1989, having the same inventors, for "Pinch Trigger Pump Water Gun", now U.S. Pat. No. 5,074,437, issued on Dec. 24, 1991.

BACKGROUND OF THE INVENTION

1. Field of the Invention

The present invention is directed to a toy water squirt gun, and more particularly to such a toy water squirt gun that uses a self-contained pumping means to draw water from at least one storage reservoir, compress an air cushion with the drawn water, and store the water pressurized by the compressed air in at least a second pressurized reservoir. The water is then released in a selective manner through a narrow nozzle, causing the stored water to be propelled forward in a narrow stream.

2. Prior Art Statement

Water guns have for decades been a very popular child's toy. Since the toy industry is very competitive, hundreds of different style water guns have been developed in an attempt to profit from the toy's inherent popularity. The most traditional forms of water guns are activated by a pumping action, either manually through the trigger or automatically through a battery operated motor. Such pump action water guns work, but the guns are limited in the distance the water traveled, the amount of water projected and the duration of the pumping cycle. In an attempt to improve upon water guns, the toy industry has developed pressure activated water guns. Such pressure activated water guns work upon the principle of pressure differentials between the water held within the toy and the atmosphere. The water within the toy is subjected to a pressure higher than that of the ambient air. As a result, when the water within the toy is given an avenue of escape, the water will stream out under the pressure. Prior art that shows pressure differential types of water guns are exemplified by the following:

U.S. Pat. No. 3,197,070 to Curtis F. Pearl et al, shows a water gun activated by trapping water in a collapsible area. As the device is collapsed, the pressure of the water builds, spraying the water out of the one small orifice left within the pressured volume. Once the confined volume is fully collapsed, the re-expansion of the volume draws forth more water from a reservoir, thus priming the water gun for another cycle. The water being pressurized is limited to the volume of the collapsible volume. The Pearl invention cannot store pressurized water for use at a later time, nor can the pressure of the water be increased by cycling the pumping action of the invention while restraining water discharge.

U.S. Pat. No. 4,854,480 to Robert S. Shindo and U.S. Pat. No. 4,735,239 to Michael E. Salmon et al, both show toy water devices that use an elastic bladder to pressurize water. The bladders are filled with high pressure water, and the bladders respond by elastically deforming. The source of pressurized water is then removed and the water within the expanded bladder is held in place by a clamping device activated by a trigger. The water gun is used by selectively releasing the clamp, allowing the water to flow from the expanded bladder.

Water guns have also been developed that use air pressure to pressurize water and force water through squirt channels. Such toys that use air pumps to pressurize water are exemplified by the following:

U.S. Pat. No. 4,214,674 to Jones et al, shows a two-piece apparatus consisting of a pressurized water reservoir and a discharging gun. Air is introduced into the water reservoir via a hand operated pump. The air pressurizes the water, forcing it up through the discharging gun, where the rate of discharge can be regulated by a trigger.

U.S. Pat. No. 4,239,129 to Gary P. Esposito describes a water pistol and/or flashlight structure which includes a reciprocal pump within the gun housing. The pump is used to pressurize air within the tank after water has been added, and a trigger is used for subsequent release of the water. Battery operated lights and sound are also provided.

U.S. Pat. No. 3,578,789, issued to Giampiero Ferri, describes a water pistol which includes a main liquid reservoir and a pressurized liquid reservoir contained within the main liquid reservoir. A trigger-actuated pump is used with a manually operated three way valve to selectively supply liquid: (a) from the pump to the pressurized reservoir; (b) from the pump to the nozzle and to the pressurized liquid reservoir; or, (c) from the pump to both the pressurized liquid reservoir and nozzle. The Ferri water gun is limited in many ways as compared to the present invention. Ferri does not have a separate hand pump but relies only upon the trigger as a pump (limited to finger pumping). Ferri requires manual valve switching with complicated steps not easily performed by young children. Ferri has limited liquid capacity as the main liquid reservoir is inside the housing (handle) and is very limited in pressurized tank capacity as the Ferri pressurized tank is within the main liquid reservoir.

Thus, although prior art does show toy water guns that have collapsible water chambers and self-contained pumping means, the prior art neither teaches nor suggests a toy water gun that uses a self-contained, hand operated water pumping device to draw both water and air or either from at least one external storage reservoir, to pressurize air with the water drawn, and to store the pressurized air and water in at least one other pressurized tank, where it can accumulate until discharged. Additionally, the safety of the invention is assured by a triggering device that automatically and safely discharges pressurized water when over pressurized, until the maximum allowable pressure is reached.

SUMMARY OF THE INVENTION

The present invention is a toy water gun having a housing with extending handle, trigger and barrel. The water gun includes at least one water storage reservoir external from and connected to the housing. The reservoir(s) have at least one orifice formed thereon for the addition and withdrawal of water therefrom, and have at least one vent to surrounding ambient air so air may enter the reservoir. Also included is at least one pressurized air and water storage tank external from and connected to the housing. The pressurized tank has only one orifice through which all liquids and gasses pass and the combined total of said water storage reservoirs and said pressurized water storage tanks is at least three. There is also a pumping means for withdrawing air or water from the water storage reservoir, and for depositing the withdrawn air or water into the pressurized tank. A plurality of one-way flow valves are included wherein at least one one-way flow valve prohibits water and air from flowing from the pressurized tank to the pumping means and at least one said one-way flow valve prohibits water and air from flowing from the pumping means to the reservoir. There is a nozzle with a narrow orifice therethrough, which affixed to the end of said barrel and an avenue of release connecting the nozzle to the pressurized tank. There is also a controlling means for regulating the flow of water and air through the avenue of release, the controlling means being actuatable by the trigger.

BRIEF DESCRIPTION OF THE DRAWINGS

The invention will be more fully understood by referring to the following detailed specifications, the above specification and the claims set forth herein, when taken in connection with the drawings appended hereto, wherein:

DETAILED DESCRIPTION OF THE PRESENT INVENTION

Figure 1:
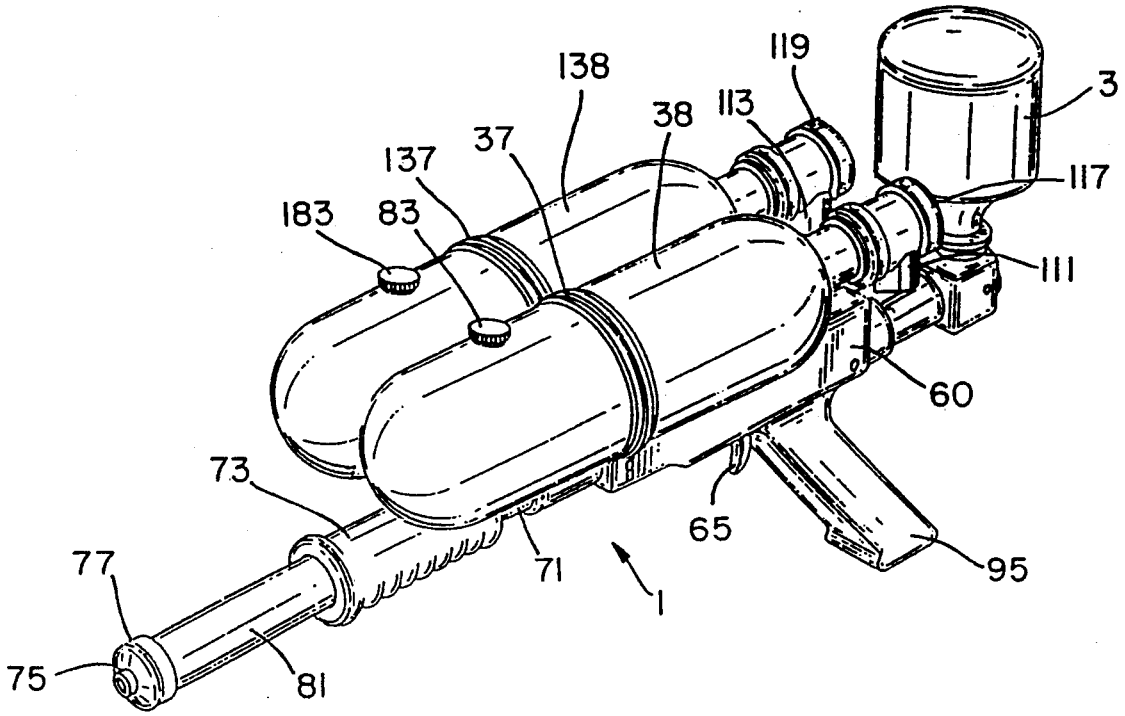
FIG. 1 shows a perspective view of one preferred embodiment of the present invention.

The present invention is, as mentioned, directed toward a toy water gun that uses a manually operated pump to draw water and/or air, and then pressurize the air to exert pressure on the water storing the water and air under pressure until selectively discharged. The science of pressurized water toys is not new, and over the years many different designs have been developed utilizing a pumping action to pressurize water. As applied to the art of toy water squirt guns, the most common type of device involves a two-stroke pump, wherein the pump draws water into a chamber through a large orifice during the priming stroke, and forces water out of the chamber through a very narrow orifice during the compression stroke. This simple system forms the basis of thousands of devices in addition to water guns, such as non-aerosol dispensing devices for hair spray, perfume, window cleaner, and countless other products that are dispensed in a narrow stream or mist.

The problem with simple two-stroke squirting systems is that the amount of liquid that can be expelled is limited to a single volume of the compressible area; also, the pressure of the liquid exiting the device is dependent directly upon the force being applied during the time of expulsion. Consequently, when water is squirted in this manner, only a small volume is released with each pumping action. When attempts are made to increase the amount of water propelled by increasing the volume of the compressible area, the pumping action cannot displace the water at a high pressure, resulting in expulsion of water at low pressures.

Water guns advantageously involve squirting large volumes of water at high pressures. The higher the pressure, the longer the distance the water can be propelled, thus increasing the range and power of the water gun. The present invention water gun uses a two-stroke pump to store and pressurize large amounts of water. The present invention draws air and a predetermined volume of water from a storage container or reservoir, pressurizes air with the drawn water and deposits the pressurized air and water in a second storage container, herein referred to as a "pressure tank", where it remains under pressure. As more and more water and/or air are drawn, pressurized and deposited within the second storage tank, the volume and the pressure on the stored water increases, compressing the air within the second or pressure tank. The water propelled by the compressed air can then be selectively released through a narrow orifice, creating a stream of propelled water. The multiple tank system i.e. storage reservoir with pressure tank, of the present invention allows the user of the invention to determine the volume and pressure of the water to be discharged, and also allows a user to refill and replace the non-pressurized water storage reservoir without disabling the water gun's ability to discharge water. The multiple tank system gives the water guns of the present invention a variety of firing characteristics that are unique in the art of toy water guns, allowing an operator to choose and adjust the range and power of the water gun. By having at least one of each, i.e. of the storage reservoir and the pressurized tank, and a total of at least three of these, increased storage for more shots, and increased pressurized water for longer duration shots are achieved.

The present invention also has other advantages over many other pressurized container water guns, in that, instead of pumping air into a chamber that already contains water, the present invention pumps water or air or water and air (hereinafter "water and/or air") into a chamber containing air. The pumping of water is more efficient than the pumping of air, thus less pumping strokes are required and higher pressures are easier to achieve.

When designing toys involving pressurized air and water, one consideration is that of safety. Toys are designed to be inexpensive so as to be widely marketable. As such, most toys are made of plastics or other inexpensive materials. Such materials do not have large tensile strengths or fatigue characteristics, and therefore do not lend themselves well to containing pressurized fluids. Plastic containments of pressurized liquids, if not properly designed, can rupture and explode, causing injury. The present invention has a unique design that allows for both the use of high pressure air and the elimination of potential rupturing hazards. The present invention, in some preferred embodiments, has one or more cylindrical pressurized tanks, each with a single orifice or opening. The single orifice, in conjunction with the generous radii used at the cylinder ends, serve to maintain the integrity of the water tank walls and minimize the stress points throughout the material of the pressurized tank, thereby allowing for the safe use of pressures generated by the present invention.

In other embodiments, the reservoirs and/or tanks may be detachable or non-detachable and may have one or more fill port orifices, located, e.g. atop or at the end of the structures.

The present invention is thus directed to a toy water gun which is operated by selectively releasing water from a pressurized water reservoir. The present invention has a manually operated pump incorporated into the design. As the pump is cycled, water and/or air are drawn from at least one water storage reservoir. Once drawn, the water and/or air are forced into at least one pressure tank. As the amount of water and/or air forced into the pressure tank increases, the pressure of the air displaced by the water within the pressure tank increases. The pressure of the air on the water within the pressure tank increases with each cycle of the pump, until the pump can no longer overcome the pressure of the air on the water within the pressure tank. The pressurized air and water within the pressure tank has an avenue of release that is regulated by the trigger mechanism of the invention which has a safety pressure release within its design. When no force is applied to the trigger, the pressurized water and air are held at bay with no means of release. When force is applied to the trigger, the heavier water is first released from the bottom of the pressurized tank and is channeled through a narrow nozzle. The escape of the pressurized water through the narrow nozzle creates a stream of propelled water that lasts as long as the trigger is engaged or until the pressure within the pressurized tank equals the ambient air pressure. The number of water storage reservoirs and pressure tanks combined totals at least three.

Figure 2:
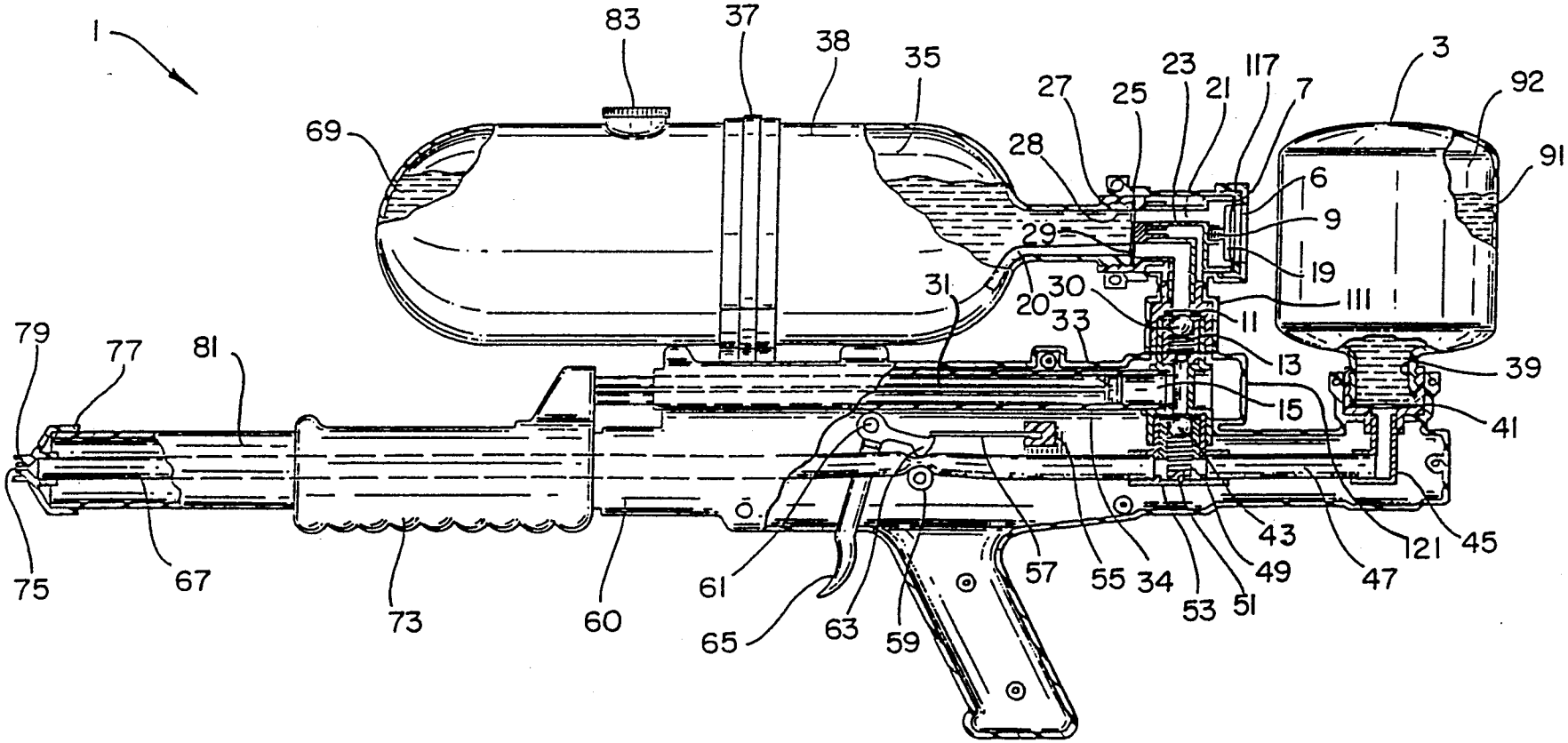
FIG. 2 shows a partially fragmented side view of the embodiment depicted in FIG. 1, illustrating the claimed inner mechanisms.

Referring now to FIGS. 1 and 2, one preferred embodiment of the present invention 1 is shown. FIG. 1 shows a perspective view of the present invention 1 and FIG. 2 shows a fragmented side view of the present invention, exposing the internal mechanisms with like parts being like numbered. As shown in FIG. 1, the embodiment shown of the present invention has two water storage reservoirs, a water storage reservoir 38 and a water storage reservoir 138, as well as pressure tank 3. In this embodiment, both storage reservoirs 38 and 138 attach to a main housing 60 that is shaped generally in the form of a gun having a handle 95, trigger 65 and barrel 81. The water storage reservoirs 38 and 138 are held firmly to the housing 60 with hoops 37 and 137. The hoops 37 and 137 minimize the stresses on the tapered neck of the storage tanks 38 and 138 as the water 69 (FIG. 2) within shifts during movement.

Referring now solely to FIG. 2, the inner workings of the present invention 1 can best be visualized and explained. Water 69 is placed within water storage tank 38 (preferably as well as in water storage tank 138, not shown in this figure because it is behind tank 38 in this side view.) The water 69 is introduced in one of two ways. First, the water 69 can be poured through the optional filling port and cap assembly 83, or, where the water storage reservoir 38 is detachable, the water storage reservoir 38 can be removed from the housing 60 and water can be poured through the neck opening of the storage tank 38. Alternatively, filling port and cap assembly 83 could be eliminated and a removable reservoir could be filled through the neck. In another embodiment, the tank 38 could be permanently attached to the housing 60 and fill would be achieved solely through filling port and cap assembly 83.

The water storage reservoir 38 is shown in FIG. 2 as being bottle shaped, with a neck terminating in a threaded head 28. The storage reservoir 38, in the shown embodiment, screws into the housing 60, and, as mentioned may be detachable or permanently attached, e.g. by glue, heat seal, one way threading or the like, or reservoir 38 can be formed unistructurally with the housing 60, and if so formed, the optional filling port and cap assembly 83 would become a necessary part of the design. It should also be understood that the storage reservoir 38 can be formed in any shape or size, as long as the design holds and stores water.

Figure 3:
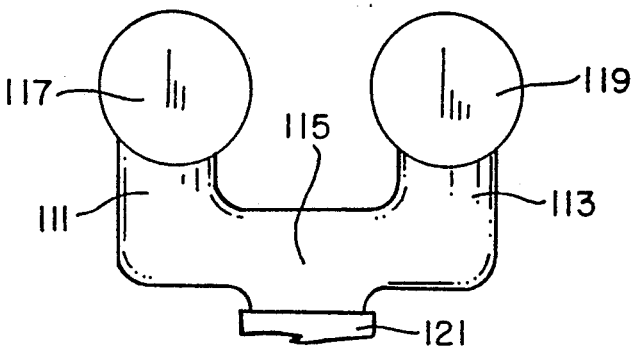
FIG. 3 shows a rear view of a portion of the reservoir connection support of the water gun shown in FIGS. 1 and 2.

Referring to FIGS. 1, 2 and 3, there is a manifold 115, which has connector ends 117 and 119 respectively for reservoirs 38 and 138. The mechanism discussed below, in conjunction with FIG. 2, contained within downpipe 111 for tank 38 is identical to that contained within downpipe 113 for tank 138. The lines contained therein operate in parallel and join with common neck 121. Thus, as above, while the following description refers to reservoir 38, it shall be taken as equally applicable to reservoir 138:

Water 63 and air from air space 35 are drawn from the storage reservoir 38 through pick-up tube 20, tube 29, etc., to tube 47 that connects with the storage reservoir 38. The invention will draw either water 63 or air 35 from the storage reservoir 38, depending on the orientation of the invention when the operator draws materials from the storage reservoir 38. As water 69 and/or air are taken from the storage reservoir 38, a partial vacuum is produced within. The vacuum is eliminated by a vent valve 19 that allows air to enter into the storage reservoir 38 as the vacuum develops. The vent valve 19 is biased by a spring 9 in the closed position, preventing water from escaping, and an optional elastomeric washer 7 helps seat the vent valve 19, enhancing its ability to prevent the escape of water. It should be understood that although a vent valve 19 is believed to be the best mode of the invention, the invention may function without such a valve so long as the storage reservoir 38 has communication with ambient air. Similarly, an elastomeric seal 25 can be used to help seat the water storage reservoir 38 against the housing 60, the elastomeric seal having an orifice therethrough, allowing for the passage of the pick up tube 20 and the vacuum venting passage 21.

The force drawing the water 69 or air from the storage reservoir 38 is created by the movement of the piston 33 within its cylinder 34. The movement of the presently preferred piston 33 within the cylinder 34 has two-cycle strokes, a priming stroke where water 69 or air are drawn forth from the water storage reservoir 38, and a compression stroke wherein water 69 or air 35 are displaced by the piston 33. In one preferred embodiment, the priming stroke starts when the piston 33 is retreated within its cylinder 34 (toward the front or left side, in FIG. 2), creating a large volume chamber 15. The vacuum created by the expanding chamber 15, draws water 69 and/or air through pick-up tube 20 and tube 29 and into the chamber 15. The flow of water 69 and/or air into the expanding chamber 15 opens a one-way valve that is normally biased in a closed position.

The one-way valve that is shown in FIG. 2 consists of a ball 30 that is biased against an elastomeric seal 11 by a spring 13. As a vacuum is created by the piston 33, the force of the spring 13 is overcome and the ball 30 drops away from the elastomeric seal 11, allowing water 69 and/or air to pass. As the piston 33 is advanced within its cylinder 34, the compression stroke begins and pressure is placed on the water 69 or air now within the chamber, is compressed closing the one-way valve by assisting the spring 13 to push the ball 30 against its seal 11. Although a ball and seal one-way valve is illustrated, it should be understood that any type of a one-way valve would work within the present invention as long as the valve made a seal that is both air and water-tight.

The compression stroke created by the advancement of the piston 33 within the cylinder 34 (to the rear or the right in FIG. 2) causes pressure to be put on the water 69 and/or air within the chamber 15. The pressurized water 69 and/or air, as a result of the diminishing volume of the compression stroke of the chamber 15, opens a second one-way valve that leads to the pressure storage tank 3 through tubes or conduits 47 and 45. As the piston 33 is reciprocated within its cylinder 34, water 69 and/or air 35 is repeatedly drawn from the storage reservoir 38 and deposited into the pressure storage tank 3. As more and more water 69 and/or air 35 is drawn and forced into the pressurized storage tank 3, the air pressure within pressure tank 3 increases until the force used to drive the piston 33 can no longer overcome the stored pressure, or until the pressure is released through the safety valve 63, normally actuated by the trigger 65.

The movement of the piston 33 within cylinder 34 draws water 69 and/or air from storage reservoir 38 into the pick-up tube 20 into tube 29. However, when the storage reservoir 38 is positioned so that the air 35 within the storage reservoir 38 is in contact with the orifice, the movement of the piston 33 will draw air 35 into the pumping chamber 15. When the pumping chamber 15 is compressed, the air will become pressurized and flow into the pressurized storage tank 3, increasing an air cushion in air space 92 in the pressurized storage tank 3, while increasing the pressure on the water but not increasing the volume of any water 91 present within the pressurized storage tank 3. By having a pumping action that can introduce both air and water 91 into the pressurized storage tank 3, the pressure of the air can be increased above that available by an air pumping system alone because of the relative inefficiency of an air pump. The pumping of water 91 is more efficient than that of air because of the incompressibility of liquids, therefore the work available from the pumping system is maximized when used to pump water against an air cushion.

The operation of the pumping action is achieved by the piston 33 being driven by a piston rod 31 that is affixed to a handle 73. The handle 73, as shown in this embodiment, is slidably attached to the barrel 81. As the handle 73 is manually reciprocated along the barrel 81, the motion is transferred to the piston 33, creating the desired pumping effect. Although a linear pumping action is shown, it should be understood that a variety of orientations and multiple linkage configurations could be manipulated by a user to create the desired pumping motion.

Once the desired pressure is obtained within the pressurized tank 3, the water 91, pressurized by the compressed air in space 92, is discharged by selectively opening an exit orifice to the surrounding ambient air. The pressure differential between the ambient air and the air in space 92 causes the water 91 to stream out. In the shown embodiment of the present invention, the pathway connecting the pressurized tank 3 to the ambient air is a series of tubes or conduits, a flexible exit tube 67, pump connection tube 47 and elbow tube 45. As water and/or air leaves the pumping chamber 15, it passes by a one-way valve 43 and into a T-shaped connection 53. The T-shaped connection 53 on one side attaches to the flexible exit tube 67, and on the other side attaches to connection tube 47. As water and/or air is forced into the T-shaped connection 53, the water and/or air tries to enter both the exit tube 67 and the connection tube 47. However, the exit tube 67 is closed by the trigger actuated pinch valve 63, leaving the connection tube 47 as the only pathway through which the water may pass. The connection tube 47 leads to the pressure tank 3 through elbow 45, consequently all air and/or water expelled by the pump is led into the pressure tank 3. When pressurized water 91, stored within the pressure tank 3 is to be discharged, the trigger 65 is depressed. The trigger 65 may be formed with a pinch bar 63 that is biased against the exit tube 67 by a spring 57. As the trigger 65 is depressed, the bias of the spring 57 is overcome and the pinch bar 63 is lifted away from the exit tube 67. With the exit tube 67 open, the integrity of the pressure tank 3 is now breached and the pressurized water 91 is offered an avenue of escape to the ambient air. The pressure differential between the pressurized air within air space 92 above water 91 in tank 3 and the ambient air causes the water 91 to flow back out through the elbow 45, through the connection tube 47, through the T-shaped connection 53 and through the exit tube 67, until the water 91 is discharged through the exit orifice 75 formed at the end of the exit tube 67.

The amount of pressurized water 91 being discharged through exit orifice 75 is controlled by the user in a variety of ways. A user can control the amount of water discharged by controlling the depression of the trigger 65. If the trigger 65 is depressed and left in that position, the pressurized water 91 will be discharged until the pressure tank 3 is empty, or until the pressure of the compressed air in air space 92 equals that of the ambient air. The user may choose to discharge the pressurized water 91 selectively, depressing the trigger 65 for short periods of time, resulting in numerous shots being allowed before the pressure tank 3 needs to be refilled or repressurized. A user may also choose to vary the pressure and amount of water being discharged by selectively adding the air within pressure tank 3. The more water 91 or air is added, the higher the pressure and the farther and longer the invention may propel water. The use of two or more storage reservoirs 38 and 138 permits the user to carry at least twice the capacity of a single reservoir and thus longer operation before going back to the water source, such as a sink faucet, hose, etc.

As mentioned, the present invention water gun is operated by selectively releasing the pressurized water 91 through a narrow nozzle 75. The selective release of the pressurized water is controlled by the trigger mechanism of the water gun. Since the present invention has the ability to operate at high pressures, the trigger release mechanism performs two functions. First, it controls the amount of water released, and second, the trigger mechanism serves as a safety valve. The presently preferred trigger 65 of the present invention has a pinch bar valve 63 that pinches the exit hosing 67 for the pressurized water 91 against a stop 59 that is part of the main housing.

The pinch bar 63 is biased against the stop 59 by a calibrated spring 57. The spring 57 is held at one end by a formation 55 of the main housing.

The strength of the spring 57 in its biased configuration is calibrated, so that when the pressure of water 91 within the exit tubing 67 reaches a predetermined maximum value, the spring 57 will allow the pinch bar 63 to rise and water 67 will be released until a safe pressure is maintained.

Thus, the predetermined maximum value for the yielding of the spring 57 or other release means may preferably be between 50 pounds per square inch and 90 pounds per square inch. Other predetermined pressures of higher or lower value e.g. 100 pounds per square inch may be used depending upon the particular components and specific configuration of a particular embodiment.

Figure 5:
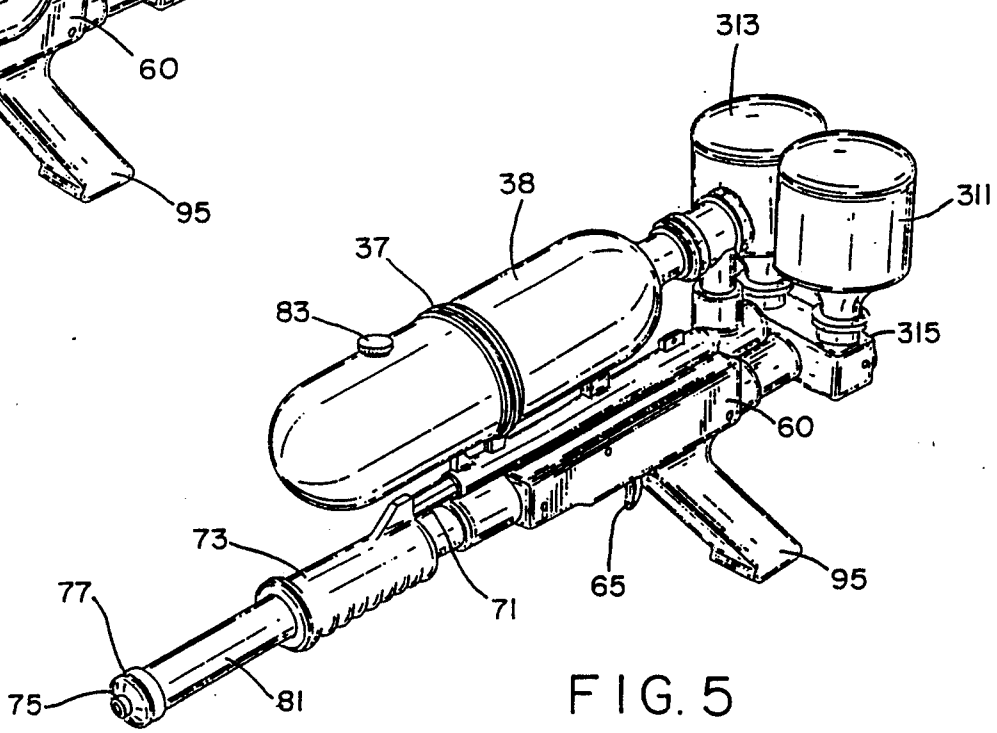
FIGS. 4, 5 and 6 respectively show perspective views of various alternative embodiment water guns of the present invention.
Figure 4:
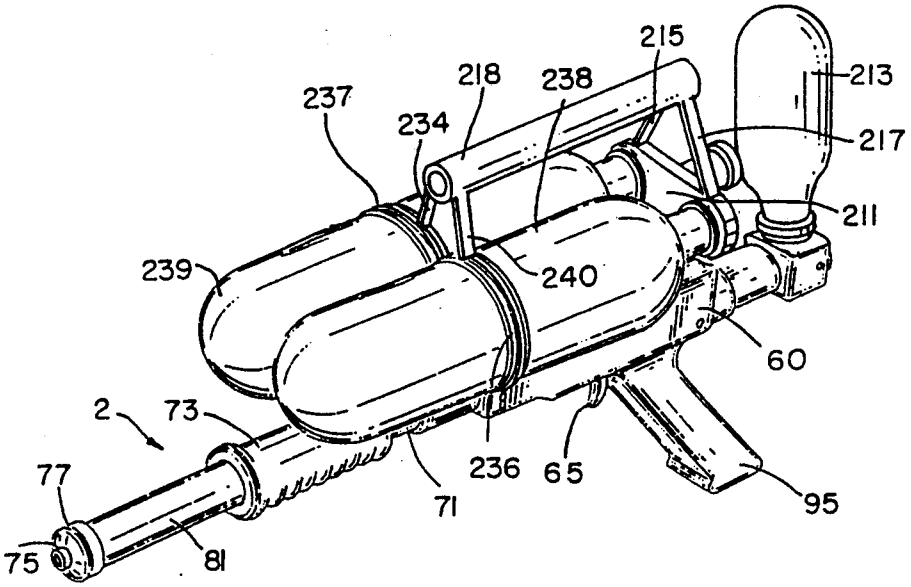
Figure 6:
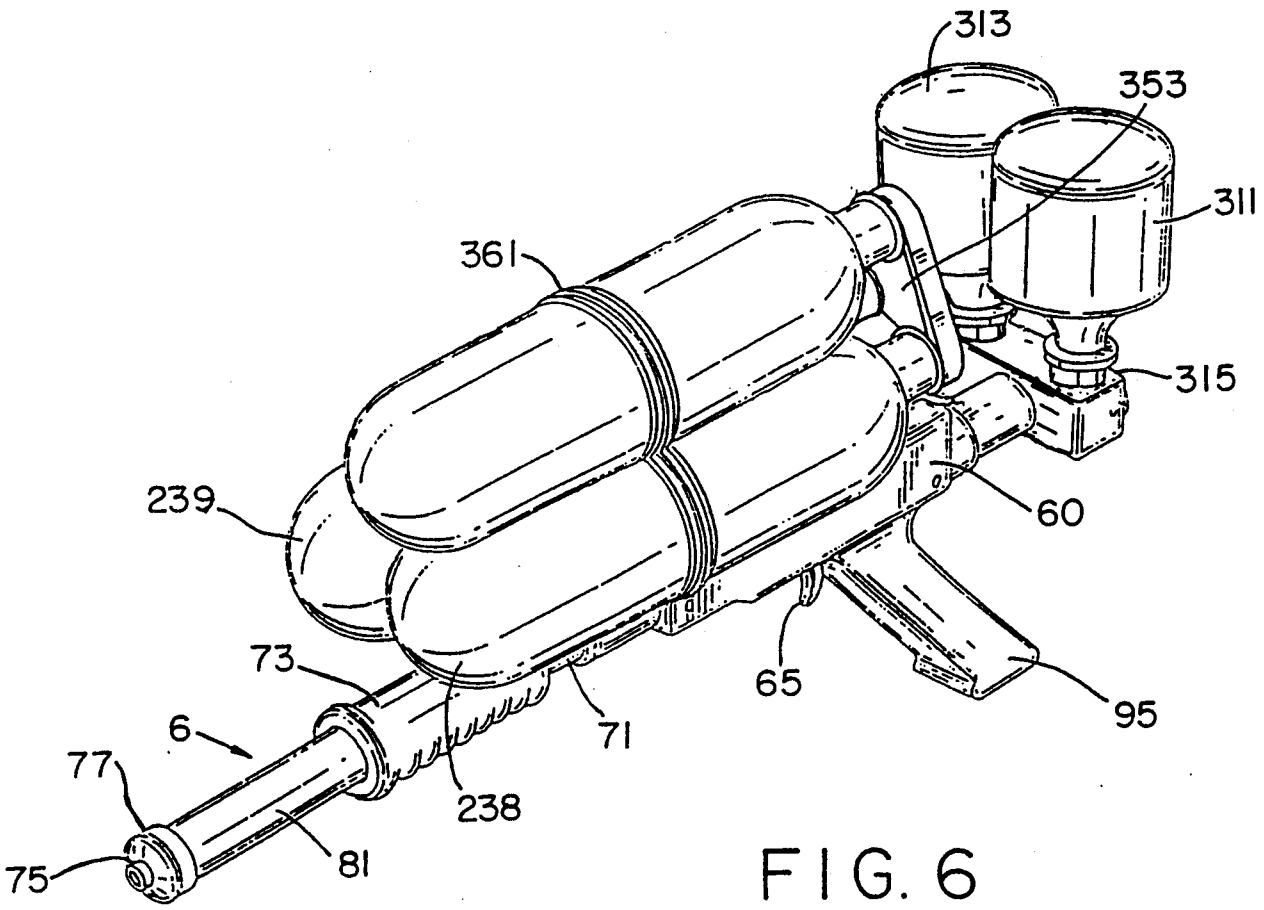

FIGS. 4, 5 and 6 show perspective views of alternative embodiments of the present invention water gun. Many components are identical to those shown in FIGS. 1 and 2 and like parts are like numbered.

FIG. 4 shows water gun 2 with storage reservoirs 238 and 239 being attached by hoops 236 and 237 and being connected at oval shaped manifold 211. Brackets 215, 217, 234 and 240 are connected at one end to the manifold 211 and hoops 237 and 236, respectively, and at the other end to a handle 218 for easy carrying. Pressure tank 213 may be light bulb shaped, as shown. This embodiment permits easier carrying and greater pressurized tank capacity than the gun 1 of FIGS. 1 through 3.

FIG. 5 shows basically a water gun 4 similar to gun 1 described above, except that double pressure tanks 311 and 313 are mounted on manifold 315 in parallel, to enhance capacity of the pressurized tanks to permit continuous shots of longer duration.

FIG. 6 combines the advantages of multiple storage reservoirs and multiple pressure tanks. Water gun 6 has three storage reservoirs 238, 239 and 242, connected to main housing 60 via common hoops 361 and connected functionally via triangular manifold 353, to operate in parallel. Alternatively, a rotatable or switchable valve could be included to select a reservoir so that reservoirs 238, 239 and 242 are emptied one at a time (in series). Pressurized tanks 311 and 313 and manifold 315, discussed above, are also included.

The above Figures show only selected embodiments of the present invention, and although these figures show preferred embodiments of the invention, it should be understood that the present invention can be practiced in many forms other than those shown. The basis of the present invention is a multiple container, reservoir or tank design with extra tank capacity using at least a total of three tanks, that uses a manual water pump and a series of one-way valves and tubes to draw ambient water from at least one storage reservoir, pumping said water into at least one pressurized tank, where it is pressurized against an air cushion, and discharge that water selectively to the ambient air. The illustrated embodiments shown in the Figures are designs for the present invention which are both efficient and inexpensive to manufacture. It should therefore be understood that in light of the appended claims, that the invention may be practiced other than as specifically described, and individual parts may be modified or connected in orientations other than those shown.

What is claimed is:

1. A toy water gun having a housing with extending handle, trigger and barrel, said water gun, comprising:

(a) at least one water storage reservoir external from and connected to said housing, said reservoir having at least one orifice formed thereon for the addition and withdrawal of water therefrom, and said reservoir having at least one vent to surrounding ambient air so that air may enter said reservoir;

(b) at least one pressurized air and water storage tank external from and connected to said housing, said pressurized air and water storage tank having only one orifice through which all liquids and gasses pass, the combined total of said at least one water storage reservoir and said at least one pressurized air and water storage tank being at least three;

(c) a pumping means for withdrawing air or water from said at least one water storage reservoir, and for depositing said withdrawn air or water into said at least one pressurized air and water storage tank;

(d) a plurality of one-way flow valves, wherein at least one of said one-way flow valves prohibits water and air from flowing from said pressurized air and water tank to said pumping means and another of said one-way flow valves prohibits water and air from following from said pumping means to said water storage reservoir;

(e) a nozzle having a narrow orifice therethrough, said nozzle being affixed to the end of said barrel;

(f) an avenue of release connecting said nozzle to said pressurized air and water tank; and, (g) a controlling means for regulating the flow of water and air through said avenue of release, said controlling means being actuatable by said trigger.

2. The water gun of claim 1, wherein withdrawal of water or air from said at least one water storage reservoir by said pumping means is determined by the level and orientation of water within aid reservoir.

3. The water gun of claim 1, wherein withdrawal of water or air from said at least one water storage reservoir by said pumping means is determined by changing the orientation of said gun.

4. The water gun of claim 1, wherein said pressurized air and water storage tank can safely hold water or air at a pressure of at least one hundred pounds per square inch.

5. The water gun of claim 1, wherein said at least one water storage reservoir has a sealable orifice therein for the addition of water thereto.

6. The water gun of claim 1, having at least two water storage reservoirs and at least two pressurized air and water storage tanks.

7. The water gun of claim 1, wherein aid vent is a one-way venting valve which allows ambient air to enter said at least one water storage reservoir through said vent while preventing water from exiting said at least one water storage reservoir through said one-way venting valve.

8. The water gun of claim 7, wherein said one-way venting valve opens each time the air pressure within said at least one water storage reservoir is less than that of the ambient air.

9. The water gun of claim 1, wherein said at least one water storage reservoir is detachable from said gun.

10. The water gun of claim 9, wherein water stored within said pressurized air and water storage tank can be dischargeable from said gun while said at least one water storage reservoir is detached from said gun.

11. The water gun of claim 1, wherein said pumping means is a reciprocatable piston within a cylinder, said pumping means having a priming stroke wherein said piston retreats within said cylinder, and a compression stroke wherein said piston advances within said cylinder.

12. The water gun of claim 11, wherein said piston is affixed to a rod, said rod terminating at a handle.

13. The water gun of claim 12, wherein said handle is slidably affixed to said barrel.

14. The water gun of claim 11, wherein said priming stroke of said pumping means draws water or air into said cylinder from said at least one water storage reservoir, past at least one of said one-way flow valves.

15. The water gun of claim 14, wherein said compression stroke of said pumping means forces said withdrawn water or air, out of said cylinder and into said pressurized air and water storage tank.

16. The water gun of claim 1, wherein said avenue of release is a flexible tube.

17. The water gun of claim 16, wherein said controlling means for regulating the flow of water through said avenue of release is a spring biased pinch bar that presses a length of said avenue of release against said housing of said water gun, selectively collapsing said length of said avenue of release.

18. The water gun of claim 17, wherein said spring biased pinch bar has a spring bias which is overcome by a force applied to said trigger, whereby said pinch bar is formed as part of said trigger and said force applied to said trigger through a lever action causes said pinch bar to move in opposition of said spring bias.

19. The water gun of claim 17, wherein said spring biased pinch bar has a spring bias created by a leaf spring having one end affixed to said housing and the other end engaging said pinch bar.

20. The water gun of claim 17, wherein said spring biased pinch bar has a spring bias calibrated to yield to pressure within said avenue of release, when said pressure within said avenue of release exceeds a predetermined maximum value.

* * * * *